United States Patent [19]

Breuer

[11] Patent Number: 4,458,449

[45] Date of Patent: Jul. 10, 1984

[54] SEPARATION FOR SHOWERS, BATHTUBS, OR THE LIKE

[76] Inventor: Horst Breuer, Auf dem Schneeberg 10, 5450 Neuwied 12, Fed. Rep. of Germany

[21] Appl. No.: 347,252

[22] Filed: Feb. 9, 1982

[30] Foreign Application Priority Data

Feb. 11, 1981 [DE] Fed. Rep. of Germany ..... 3104871

[51] Int. Cl.[3] ..... E05D 13/02

[52] U.S. Cl. ..... 49/411

[58] Field of Search ..... 49/411, 410, 409; 4/557, 607, 610

[56] References Cited

U.S. PATENT DOCUMENTS

| | | | |
|---|---|---|---|
| 2,980,969 | 4/1961 | Tinfow | 49/411 |
| 3,384,998 | 5/1968 | Abramson | 49/411 |
| 4,258,443 | 3/1981 | Baus | 49/411 X |

FOREIGN PATENT DOCUMENTS

| | | | |
|---|---|---|---|
| 2845876 | 4/1980 | Fed. Rep. of Germany | 4/607 |

*Primary Examiner*—Philip C. Kannan

*Attorney, Agent, or Firm*—Becker & Becker, Inc.

[57] ABSTRACT

A separation for showers, bathtubs, or the like, including: a stationary, closed frame, made of several frame parts, for guiding at least one movable door element, and, if appropriate, for fastening a stationary door element; the at least one movable door element being suspended by rollers on the upper frame part of the frame; a seal for sealing the closed separation against discharging splashed or sprayed water; a closed lower frame part of the stationary frame, this lower frame part having a box-like cross section, an upwardly directed narrowed portion of predetermined height and width, and an inclined run-off surface adjoining one side of the narrowed portion; and a movable door element, the lower frame part of which faces the mentioned frame part of the stationary frame, and is provided with a downwardly open recess which conforms to the narrowed portion of the stationary frame part.

6 Claims, 2 Drawing Figures

SEPARATION FOR SHOWERS, BATHTUBS, OR THE LIKE

The present invention relates to a separation or partition for showers, bathtubs, or the like, and comprises: a stationary, closed frame, made of several frame parts, for guiding at least one movable door element, and, if appropriate, for fastening a stationary door element; said at least one movable door element being suspended by rollers on the upper frame part of the frame; and means for sealing the closed separation against discharging sprayed or splashed water.

A separation which has made improvements with regard to operational advantages and hygiene, along with the details which are important in this connection, has already been disclosed in German Gebrauchsmuster No. 80 00 846, which belongs to the present applicant. However, this known solution is relatively costly, and, because of its configuration, still gives rise to possibilities for deposits of lime and dirt contained in the water, and also makes it somewhat difficult to clean.

It is therefore an object of the present invention to further improve a shower separation of the initially mentioned type with respect to its operational advantages, with respect to the cost for the production of the individual parts as well as of the entire separation, and also with respect to the ease of any cleaning which might become necessary.

Figure 1:
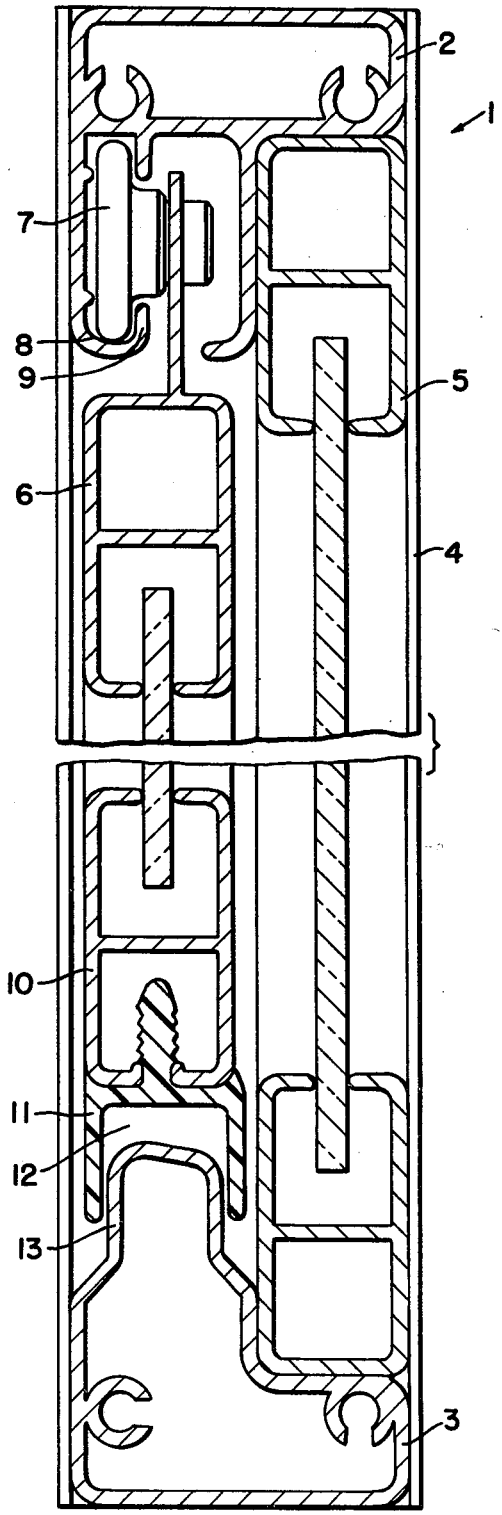
Figure 2:
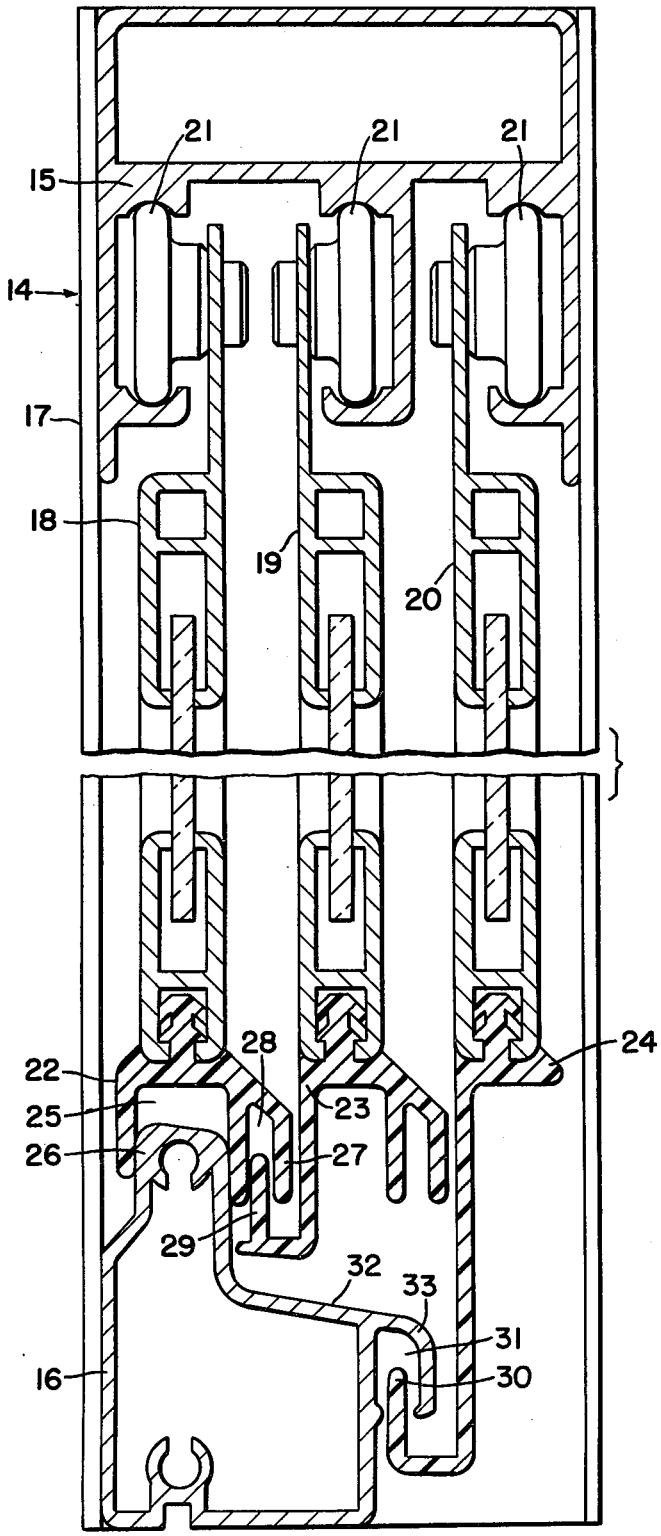

This object, and other objects and advantages of the present invention, will appear more clearly from the following specification in connection with the accompanying drawings, in which:

FIG. 1 is a sectioned side view of a separation for a stationary door element and a movable door element in accordance with the present invention; and FIG. 2 shows a separation according to the present invention for a total of three movable door elements.

The separation of the present invention is characterized primarily by a closed lower frame part of the stationary frame, this lower frame part having a box-like cross section, an upwardly directed narrowed portion of predetermined height and width, and an inclined run-off surface adjoining one side of the narrowed portion; and also characterized by a movable door element, the lower frame part of which faces the mentioned frame part of the stationary frame, and is provided with a downwardly open recess which fits or conforms to the narrowed portion of said stationary frame part.

The inventive separation first of all has the advantage that, as a consequence of the proposed configuration of the lower frame part of the stationary frame, and of the conforming configuration of the lower frame of the movable door element associated therewith (in the event of only one movable door element), cost can be saved during the production of the individual parts because of the collectively simpler construction.

Additionally, the inventive combination of elements under consideration offers fewer possibilities for deposits of lime, dirt, and the like; cleaning is more easily possible, and requires less time.

Finally, for the foregoing reasons, readily recognizable advantages result for such a separation in daily usage.

Conventional separations of this type have frame parts of aluminum. The lower frame part of the movable door element of the present invention can also be made of aluminum, and can even form a unit with this lower frame part. However, in order to obtain an operation of the movable door element which is as free of noise as possible, and in order to obtain as good a seal against splashed or sprayed water as possible, it is further proposed in accordance with the present invention that a sealing- and guide element, preferably of synthetic material, be connected to the lower, preferably aluminum, frame part of the movable door element.

In the event not only one movable door element, but rather two such door elements are to be utilized, it is furthermore proposed according to the present invention that on the guide element of the first movable door element there be provided a lateral, downwardly directed, finger-like extension in order to form a guide groove for a corresponding guide rib of a further, second movable door element.

In the event that three movable door elements are to be provided, it is further expediently proposed that the indicated lower frame part of the stationary frame have a downwardly directed extension connected to the inclined run-off surface in order to form a guide groove for an upwardly directed leg of a lower guide- and sealing element of the third movable door element.

Referring now to the drawings in detail, FIG. 1 shows a separation 1 having an upper frame part 2, a lower frame part 3, and similar side frame parts 4. A stationary door element 5 is fastened or secured in a known manner between the frame parts 2 and 3, as indicated in the drawing. Furthermore, a movable door element 6 is provided between the frame parts 2 and 3. The door element 6 is guided in a known manner, by means of a roller 7, in a track or guide groove 8, which is formed by an extension 9 of the frame part 2.

A sealing- and guide element 11 is secured to the lower end of the movable door element 6, on the lower frame part 10 thereof. This may be accomplished, for example, as illustrated, by means of an extension with a barbed toothing on the element 11, and a corresponding recess in the frame part 10. The guide element 11, which aside from guidance also serves for sealing-off against splashed or sprayed water, has a downwardly open recess 12. The closed lower frame part 3 of the stationary frame of the separation 1 has a box-like cross section, and is provided with an upwardly directed narrowed portion 13 which engages in the recess 12. The recess 12 in the guide element 11, and the narrowed portion 13 of the frame part 3, are expediently embodied in such a manner that the lateral legs of the guide element 11, which legs define the recess 12, engage with slight pressure against the corresponding surfaces of the narrowed portion 13.

The combination of the aforementioned features of the movable door element results in a separation which costs less to produce than similar heretofore known separations, and with which there is practically no longer any possibility for deposits of lime, dirt, and the like; the inventive separation is distinguished by being extremely easy to clean, and with which additionally a good operation of the movable door element is attainable and can be maintained over a long period of use.

FIG. 2 shows a separation 14, which comprises an upper frame part 15, a lower frame part 16, similar side frame parts 17, as well as movable door elements 18, 19, and 20.

The door elements 18, 19, and 20 are guided in a known manner, by rollers 21, in tracks or guide grooves of the upper frame part 15. Several sealing- and guide elements 22, 23, and 24 are secured in the lower frame parts of the door elements 18, 19, and 20, in a manner recognizable from the drawing and in a manner similar to the situation for the illustration of FIG. 1. The guide element 22 of the door element 18, as in the case of the door element 6 of FIG. 1, is guided by means of a downwardly open recess 25 on an upwardly directed narrowed portion 26 of the lower frame part 16 of the stationary frame, which lower frame part 16 has a box-like cross section.

A finger-like, downwardly directed extension 27 on the guide element 22 serves to guide the second movable door element 19, and also serves to seal-off the shower or bath chamber outwardly against splashed or sprayed water. The extension 27 and the adjoining leg of the guide element 22 together form a guide groove 28 in which engages a guide rib 29, which represents an extension of a leg of the sealing- and guide element 23 of the second movable door element 19.

To provide lower guidance of the third movable door element 20, the sealing- and guide element 24 associated therewith has an upwardly directed leg 30 which engages in a guide groove 31. The guide groove 31 is formed by a downwardly directed extension 33 adjoining the inclined run-off or discharge surface 32, and by the oppositely located wall region of the lower frame part 16.

If there are only two movable door elements, the extension 33 can, of course, be eliminated, so that the lower frame part of the stationary frame then corresponds to the frame part 3 of FIG. 1.

The present invention is, of course, in no way restricted to the specific disclosure of the specification and drawings, but also encompasses any modifications within the scope of the appended claims.

Applicant has referred to preferably making the sealing- and guide elements 11 and 22–24 of synthetic material. Any suitable synthetic material can be used, for example, polyvinyl chloride (PVC). It should also be noted that the central portions of the door elements 5,6 and 18–20 are preferably made of a translucent or transparent material, such as, for example, acrylic resins.

What I claim is:

1. A separation for showers, bathtubs, and the like comprising in combination:

a closed stationary frame, which includes an upper stationary frame part, a lower stationary frame part, and side frame parts interconnecting said upper and lower stationary frame parts;

at least two door elements mounted in said stationary frame and being respectively provided with upper and lower door frame parts, at least one of said door elements being movably mounted in, and guided by, said stationary frame;

rollers connected to said upper door frame part of each of said movable doors, said rollers being supported by said upper stationary frame part for effecting in part said movable guidance of said movable doors;

said lower stationary frame part having a closed box-like cross section, an upwardly directed narrowed portion, and an inclined run-off surface adjoining one side of said narrowed portion; and said lower door frame part of one of said at least one movable door elements facing said lower stationary frame part and being provided with a downwardly open recess which conforms to, and is mounted over, said narrowed portion of said lower stationary frame part to effect the remainder of said guidance of said movable doors, and to seal said separation closed on all sides thereof, in its closed state, against splashed or sprayed water with contaminant deposits.

2. A separation in combination according to claim 1, in which said lower door frame part of one of said at least one movable door element over entire width includes a sealing and guide element which is provided with said downwardly open recess which conforms to, and is mounted over, said narrowed portion of said lower stationary frame part.

3. A separation in combination according to claim 2, in which said lower door frame part is made of aluminum, and said sealing- and guide element is made of synthetic material.

4. A separation in combination according to claim 2, which includes at least two movable door elements, with a first one of said movable door elements being provided with said sealing- and guide element which is provided with said conforming recess, and with the remaining at least one additional movable door element having respectively associated therewith an upwardly directed guide rib, said sealing- and guide element of said first one of said movable door elements being provided with a lateral, downwardly directed, finger-like extension in order to form a guide groove for said guide rib of that movable door element adjacent said first one of said movable door elements.

5. A separation in combination according to claim 4, which includes three movable door elements, with a first one of said movable door elements being provided with said sealing- and guide element which is provided with said conforming recess, and with said second and third movable door elements having respectively associated therewith one of said guide ribs, said second movable door element being adjacent said first movable door element, and said third movable door element being remote from said first movable door element and adjacent said second movable door element; said lower stationary frame part being provided with a downwardly directed extension, connected to said inclined run-off surface remote from said narrowed portion, in order to form a guide groove for said upwardly directed guide rib of said third movable door element.

6. A separation in combination according to claim 5, in which said lower door frame parts of said second and third movable door elements over entire width respectively include a sealing- and guide element, each of which is provided with said upwardly directed guide rib of its associated door element.

* * * * *